US006259217B1

(12) United States Patent
Song

(10) Patent No.: US 6,259,217 B1
(45) **Date of Patent: *Jul. 10, 2001**

(54) WIDE BAND HORIZONTAL SIZE REGULATION CIRCUIT OF A DISPLAY

(75) Inventor: Moon-Jong Song, Suwon-si (KR)

(73) Assignee: SamSung Electronics Co., Ltd., Suwon (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/074,516

(22) Filed: May 8, 1998

(30) Foreign Application Priority Data

May 8, 1997 (KR) ..... 97-10110

(51) Int. Cl.[7] ..... G09G 1/04
(52) U.S. Cl. ..... 315/387; 315/371; 315/411
(58) Field of Search ..... 315/387, 371, 315/411

(56) References Cited

U.S. PATENT DOCUMENTS 4,716,321 * 12/1987 Erratico ..... 307/308
5,283,505 * 2/1994 Bando ..... 315/411
5,714,849 * 2/1998 Lee ..... 315/408
5,751,370 * 5/1998 Lee ..... 348/556
5,754,415 * 5/1998 Blackmon ..... 363/21
5,831,398 * 11/1998 Kim ..... 315/371
5,994,852 * 11/1999 Lee ..... 315/408
6,020,694 * 2/2000 Shim ..... 315/387
6,023,191 * 2/2000 Connell et al. ..... 327/554

* cited by examiner

*Primary Examiner*—Seungsook Ham
*Assistant Examiner*—Shun Lee
(74) *Attorney, Agent, or Firm*—Robert E. Bushnell, Esq.

(57) ABSTRACT

A wide band horizontal size regulation circuit of a display, is selectively switched according to input frequency, to control the amount of current transmitted to a current sensing port of a PWM IC. This circuit includes a microcomputer for generating a signal for regulating the horizontal size of a picture, a PWM-IC for generating a PWM signal for controlling the amount of current which flows through a horizontal deflection coil according to the control signal of the microcomputer, a current sensor for feeding back a current corresponding to a picture state to the PWM-IC in order to maintain a specific horizontal size, and a current controller which is selectively switched according to the control signal of the microcomputer, to control the amount of current fed back to the current sensor of the PWM-IC. The control signal of the microcomputer is varied with input frequencies, to control the amount of current transmitted from the horizontal output circuit to the PWM-IC, thereby regulating the horizontal size for a wide band of frequencies.

6 Claims, 6 Drawing Sheets

WIDE BAND HORIZONTAL SIZE REGULATION CIRCUIT OF A DISPLAY

CLAIM OF PRIORITY

This application makes reference to, incorporates the same herein, and claims all benefits accruing under 35 U.S.C. §119 from my application entitled WIDE BAND HORIZONTAL SIZE REGULATION CIRCUIT OF DISPLAY DEVICE filed with the Korean Industrial Property Office on May 8, 1997 and there duly assigned Serial No. 97-10110 by that Office.

BACKGROUND OF THE INVENTION

1 Field of the Invention

The present invention relates to a display and, more particularly, to a wide band horizontal size regulation circuit which is selectively switched according to input frequencies, to control the value of current fed back, thereby adjusting the horizontal size of the display.

2 Detailed Description of Related Art

A display is a typical peripheral device of a computer, which displays a signal sent from the computer as an image, to allow a user to recognize it.

The display typically includes a video card, contained within a computer for providing a video signal, horizontal and vertical synchronous signals which are required for forming an image, a microcomputer for receiving the horizontal and vertical synchronous signals form the video card and for generating a picture control signal for controlling the monitor picture, vertical and horizontal deflection circuits for receiving the horizontal and vertical synchronous signals and for performing horizontal and vertical deflections to enable an electron beam generated by an electron gun of a CRT to be sequentially deflected starting from the top of the left portion of the CRT proceeding to the bottom of its right portion by a deflection yoke so as to form an image comprising a picture, a high voltage circuit for supplying a high voltage to the anode of the CRT using a blanking pulse generated by an output of the horizontal deflection circuit, a video preamplifier for amplifying a low-level image signal transmitted from the video card and a video main amplifier for amplifying the signal amplified by the video preamplifier.

The horizontal deflection circuit includes a horizontal oscillator circuit, horizontal drive circuit, a horizontal output circuit, and a horizontal size regulation circuit.

The horizontal output circuit and horizontal size regulation circuit include the microcomputer for generating a horizontal size control signal, a pulse width modulation IC for varying the width of a pulse for controlling the horizontal size according to the control signal generated by the microcomputer, a deflection controller for controlling the amount of current which flows through the choke coil of the horizontal output circuit, a current sensor for sensing the horizontal flyback pulse from the choke coil of the horizontal output circuit to provide it to the PWM-IC, a horizontal yoke for receiving the sawtooth wave output current from the horizontal output circuit and for providing deflection power and a linearity circuit and S-correction circuit which operate by a control signal from the microcomputer according to an input frequency.

The horizontal output circuit and horizontal size regulation circuit include the deflection controller containing a transformer and field effect transistor and various resistors.

Also included is a current sensor consisting of a diode and resistor capacitor combination for sensing and rectifying and smoothing the horizontal flyback pulse from a chopper coil of the horizontal output circuit and for transmitting the sensed voltage to the PWM-IC.

The operation of such a size regulation circuit is as follows. The on/off time of the field effect transistor is controlled according to a pulse width regulation signal output from the PWM-IC. The transistor is turned on during the on time of a pulse supplied from the transformer and turned off during its off time. Accordingly, the chopper coil of the horizontal output circuit is charged during the turned on time of the transistor and discharged during its turned off time, generating the horizontal flyback pulse. However, the size regulation voltage is fed back from the chopper coil to control the size. Thus, the detection value varies with the tolerance of the chopper coil and furthermore, the horizontal size regulation circuit can not adequately meet input frequency modes presently used with various computer systems.

SUMMARY OF THE INVENTION

An objective of the present invention is to provide a wide band horizontal size regulation circuit of a display, which adequately controls current, fed back to a PWM-IC according to an input frequency, using a microcomputer.

To achieve these and other advantages and in accordance with the purpose of the present invention, as embodied and broadly described, there is provided a wide band horizontal size regulation circuit of a display including a microcomputer for generating a signal for regulating the horizontal size of a picture, a PWM-IC for generating a PWM signal for controlling the amount of current which flows through a horizontal deflection coil according to the control signal of the microcomputer, a current sensor for feeding back a current picture state to the PWM-IC in order to maintain a specific horizontal size, and a current controller which is selectively switched according to the control signal of the microcomputer, to control the amount of current fed back to the current sensor of the PWM-IC.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols represent the same or similar components, wherein.

DETAILED DESCRIPTION OF PREFERRED EMBODIMENT

Reference will now be made in detail to the preferred embodiments of the present invention, examples of which are illustrated in the accompanying drawings.

Figure 1:
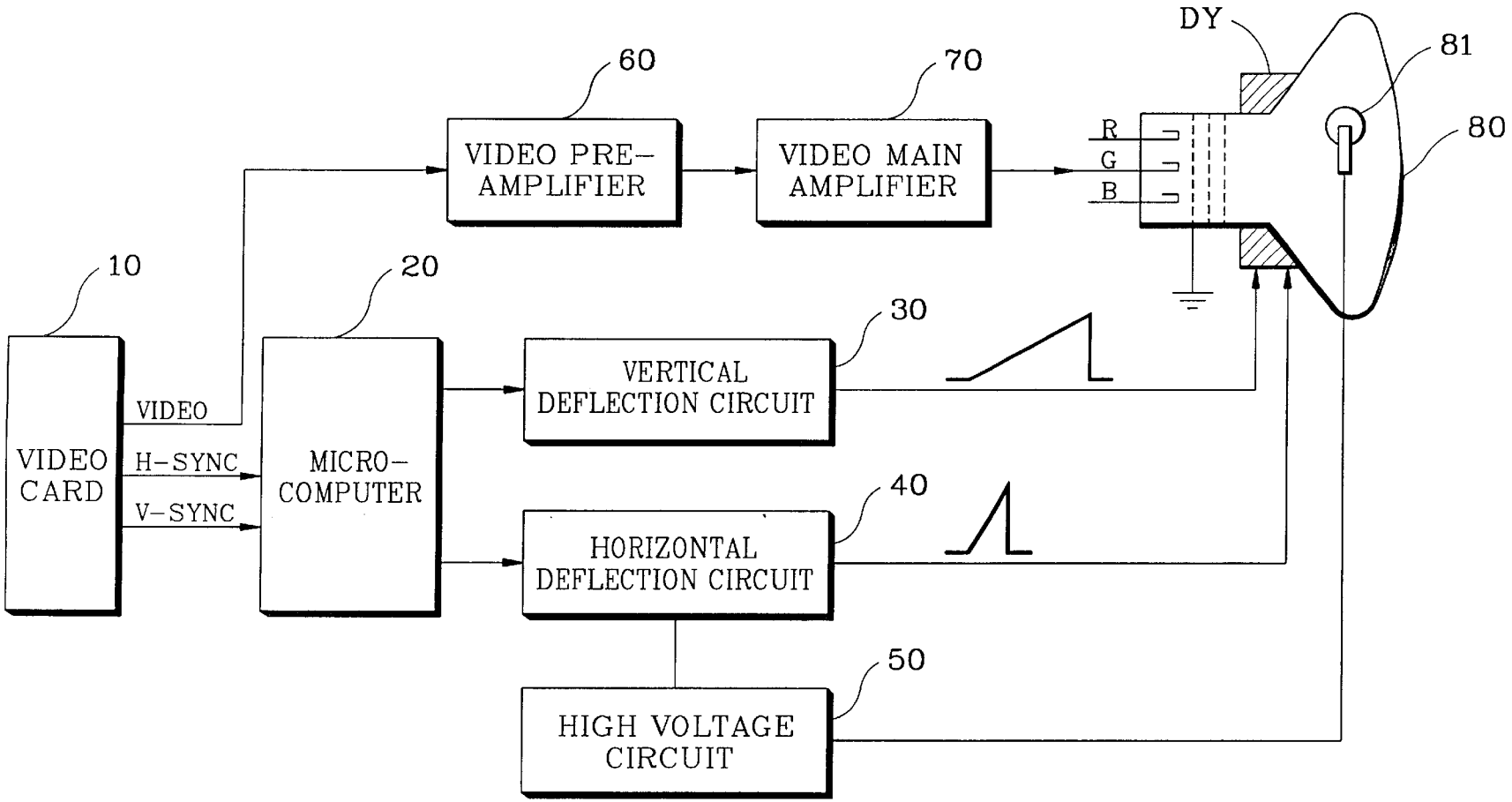
FIG. 1 is a block diagram of an earlier display device.

The basic configuration of a display is described below with reference to FIG. 1. As shown in FIG. 1, the display includes: a video card 10, set in a computer (not shown), for providing a video signal (R,G,B), horizontal and vertical synchronous signals H-Sync/V-Sync, which are required for forming an image; a microcomputer 20 for receiving the horizontal and vertical synchronous signals from the video card 10 and for generating a picture control signal for controlling the monitor picture; vertical and horizontal deflection circuits 30 and 40 for receiving the horizontal and vertical synchronous signals and performing horizontal and vertical deflections, to enable an electron beam generated by an electron gun of a CRT 80 to be sequentially deflected starting from the top of the left portion of the CRT 80 to the bottom of its right portion by a deflection yoke, thereby forming an image comprising one picture; a high voltage circuit 50 for supplying a high voltage to the anode 81 of the CRT 80 using a blanking pulse generated by an output port of horizontal deflection circuit 40, according to the principles of switching circuits and high voltage techniques; a video pre-amplifier amplifier 60 for amplifying a low-level image signal (R,G,B) transmitted from the video card 10 with a low voltage amplifier, to maintain a specific voltage level; and a video main amplifier 70 for amplifying the signal amplified by the video pre-amplifier 60 to 40 Vpp to 60 Vpp of signal, supplying energy to each pixel of the display.

Figure 2:
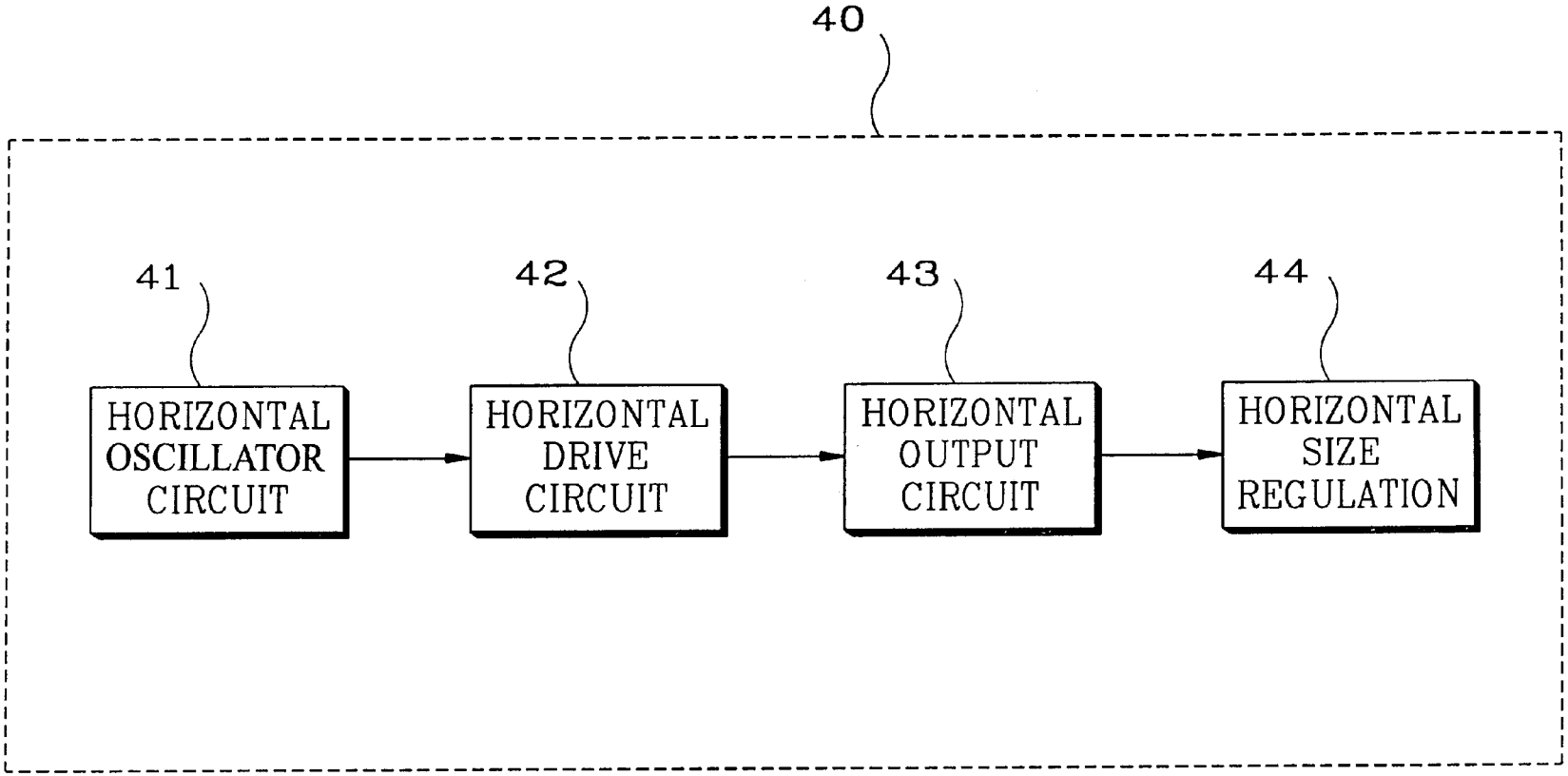
FIG. 2 is a block diagram showing the horizontal deflection circuit of FIG. 1 in detail.

This display forms an image using the electron beam projected onto its fluorescent screen. A circuit for deflecting the electron beam is called a deflection circuit. The deflection mode, generally, is divided into electrostatic deflection using an electric field and electromagnetic deflection using a magnetic field. The electromagnetic deflection is used, for example, in a TV in which a sawtooth current flows through horizontal and vertical coils to form pictures. A general configuration of the horizontal deflection circuit 40 is shown in FIG. 2. Referring to FIG. 2, the horizontal deflection circuit includes a horizontal oscillator circuit 41 which generally uses a blocking oscillator circuit, a horizontal drive circuit 42 for one-stage- or two-stage current amplification using a transistor TR or field effect transistor FET, to provide a base current sufficient for turning on/off an output transistor of a horizontal output circuit 43, and for performing waveform correction, and a horizontal output circuit 43 for generating a sawtooth current which flows through a deflection coil using the switching operation of a transistor. A horizontal size regulation circuit 44 is connected to the horizontal output circuit 43, to maintain a specific horizontal size of the picture of the display device all the time.

Figure 3:
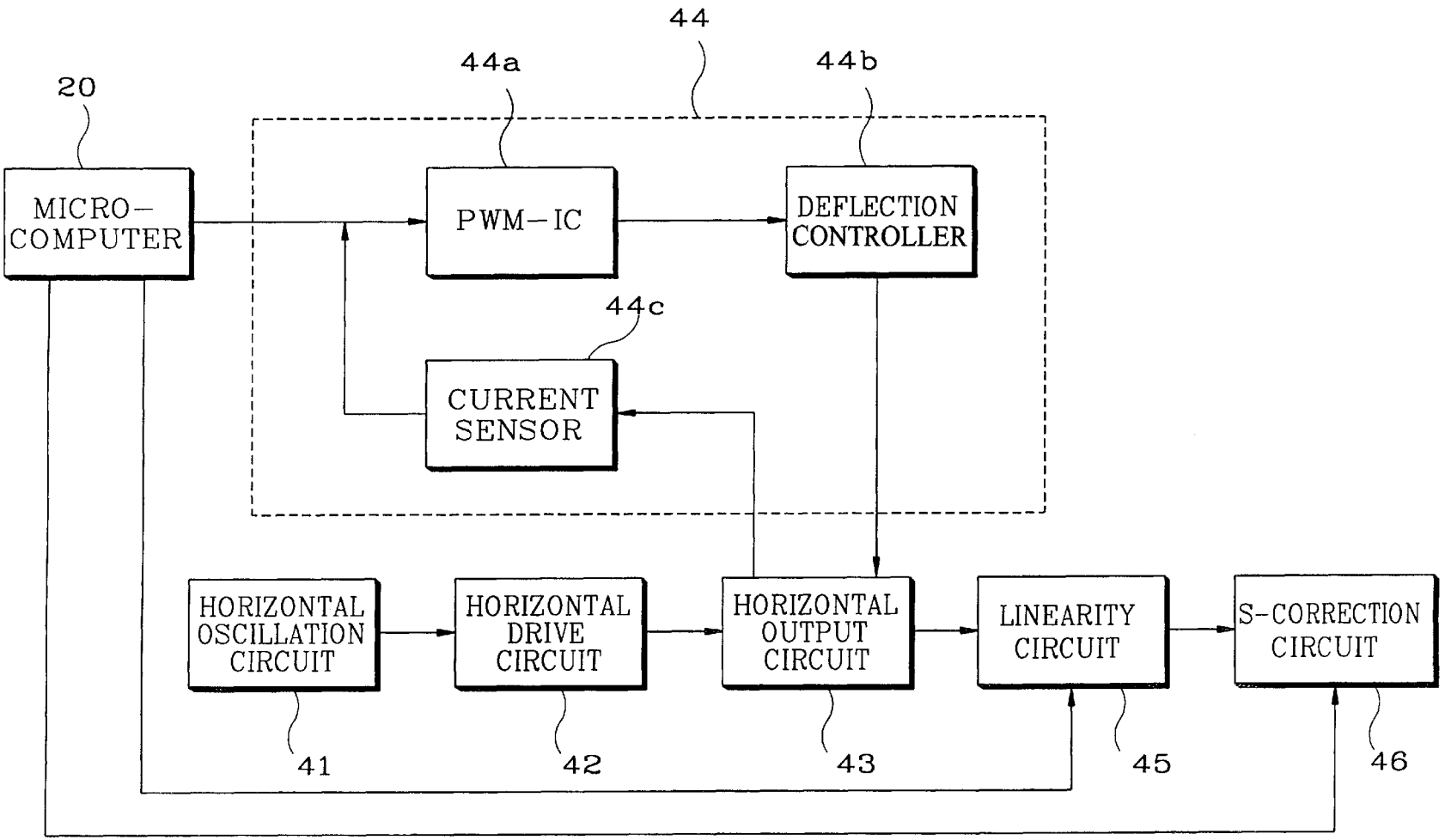
FIG. 3 is a bock diagram of an earlier horizontal size regulation circuit.

FIG. 3 shows detailed configurations of an earlier horizontal output circuit and horizontal size regulation circuit. The horizontal output circuit and horizontal size regulation circuit include the microcomputer 20 for generating a horizontal size control signal, a pulse width modulation integrated circuit (referred to as a PWM-IC hereinafter) 44*a* for varying the width of a pulse for controlling the horizontal size according to the control signal generated by the microcomputer 20, a deflection controller 44*b* for controlling the amount of current which flows through the choke coil of the horizontal output circuit, a current sensor 44*c* for sensing the horizontal flyback pulse from the choke coil of the horizontal output circuit 43 to provide it to PWM-IC 44*a*, a horizontal yoke H-DY (not shown) for receiving the sawtooth wave output current from the horizontal output circuit 43 and for providing deflection power to the direction of the electron beam from the CRT, and a linearity circuit 45 and S-correction circuit 46 which operate by a control signal from the microcomputer according to an input frequency.

Figure 4:
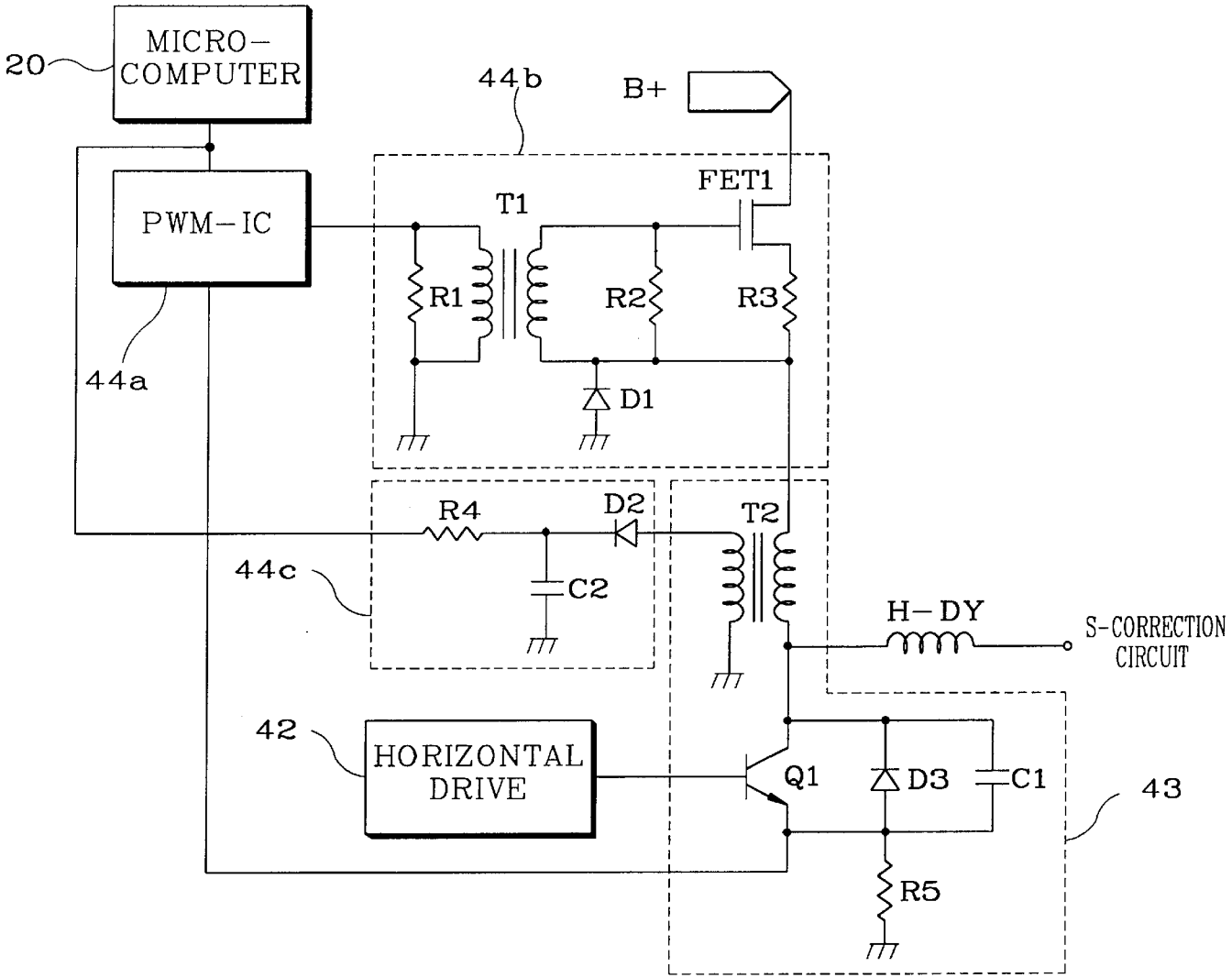
FIG. 4 is a block diagram showing the configuration of the circuit of FIG. 3 in detail.

FIG. 4 shows the configuration of the horizontal output circuit 43 and horizontal size regulation circuit 44 of FIG. 3 in more detail. Referring to FIG. 4, the deflection controller 44*b* includes a resistor R1 for detecting the output signal of the PWM-IC 44*a*, a transformer T1 for inducing the voltage of the output signal to the following stage, a resistor R2 for transmitting the induced voltage of transformer T1, a diode D1 for preventing an inverse voltage in transformer T1, a field effect transistor FET1 for receiving the induced voltage at its gate connected to resistor R2, to control the amount of current provided to a chopper coil T2 of the horizontal output circuit 43 using the amount of current which flows through its source, and a detection resistor R3 connected to the source of the FET1.

Current sensor 44*c* consists of a diode D2 for sensing and rectifying the horizontal flyback pulse voltage from the chopper coil T2 of the horizontal output circuit 43, a smoothing capacitor C2 and a resistor R4 for transmitting the sensed voltage to the PWM-IC 44*a*. The horizontal output circuit 43 includes a horizontal output transistor Q1 for receiving the output signal of the horizontal drive circuit 42 at its base, a damping diode D3, and a capocitor C1 which are connected in parallel across the collector and emitter of the transistor Q1, with a resistor R5 connected to ground and to the diode D3 and to the capacitor C1, and a horizontal deflection coil H-DY connected to the collector of the transistor Q1.

The operation of the size regulation circuit constructed as above is explained below. The ON/OFF time of field effect transistor FET1 connected to the secondary side of the transformer T1 is controlled according to a pulse width regulation signal output from the PWM-IC 44*a*. The transistor FET1 is turned on during the on time of a pulse supplied from transformer T1, and turned off during its off time. Accordingly, the chopper coil T2, which receives current through the source of transistor FET1, is charged during the turned on time of transistor FET1, and discharged during its turned off time, generating the horizontal flyback pulse. However, in this horizontal size regulation circuit, the size regulation voltage is fed back from chopper coil T2 to control the size. Thus, the detection value varies with the tolerance of the chopper coil T2. Furthermore, the horizontal size regulation circuit cannot adequately meet input frequency modes.

Figure 5:
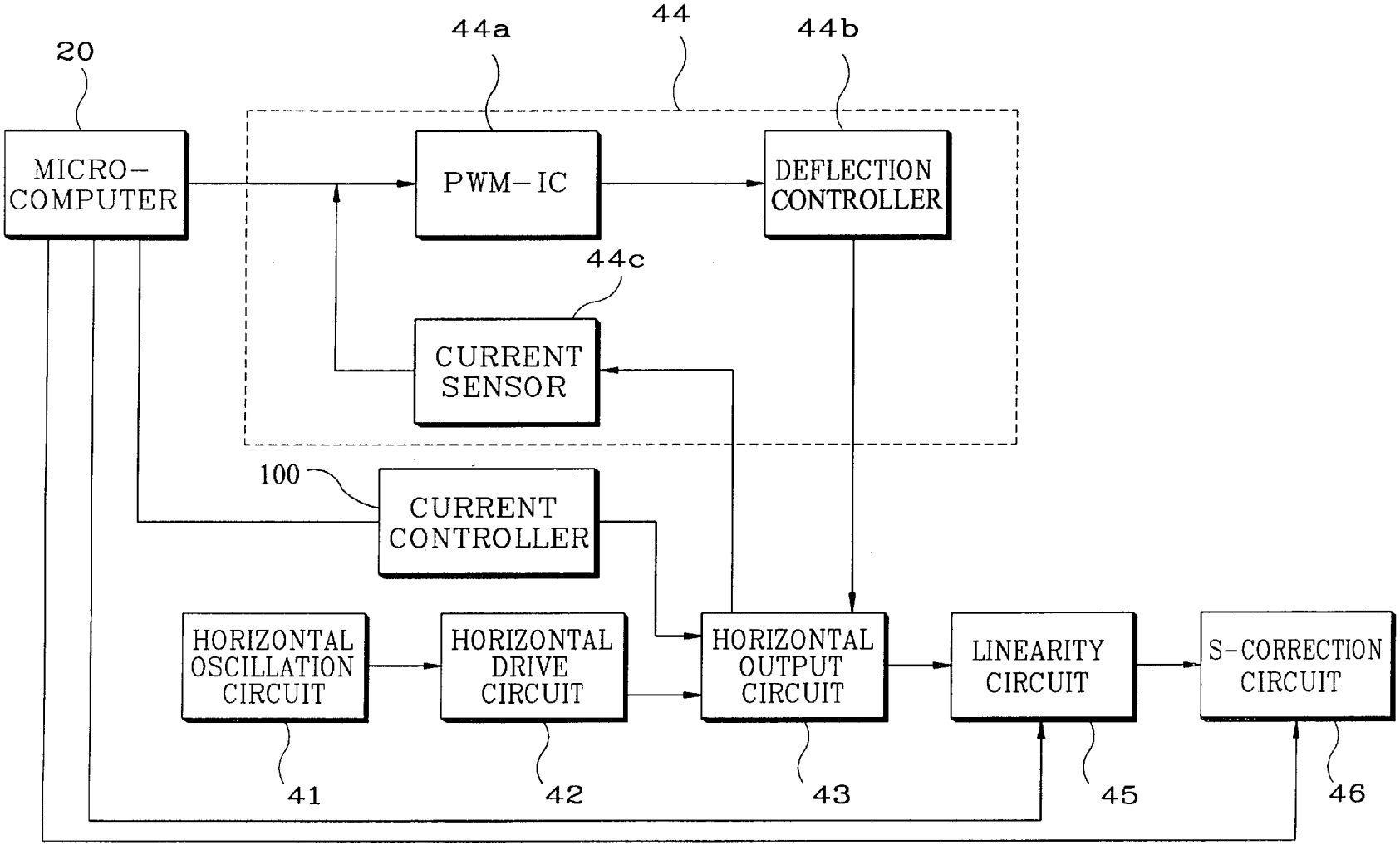
FIG. 5 is a block diagram of a wide band horizontal size regulation circuit according to the present invention.
Figure 6:
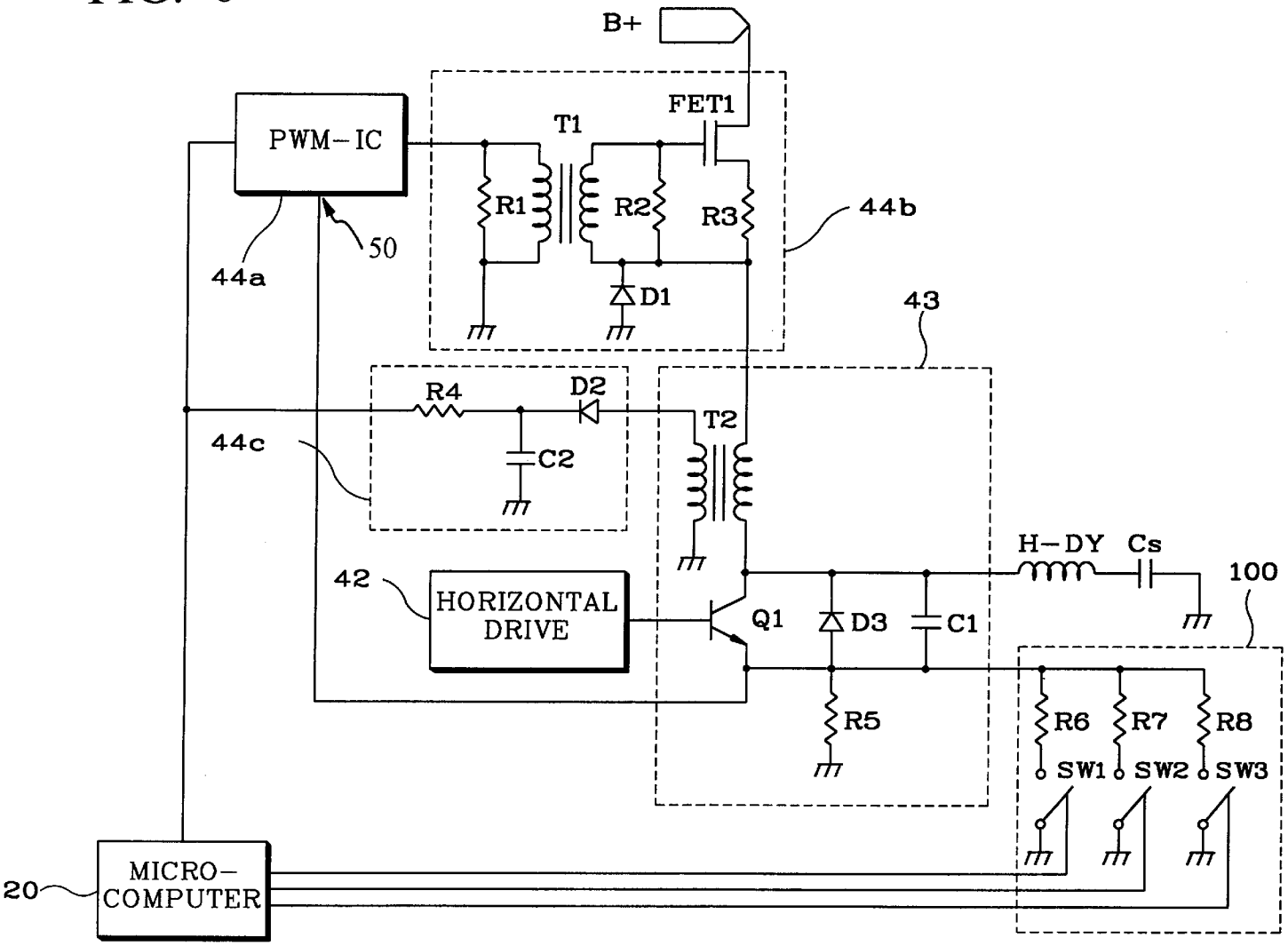
FIG. 6 is a block diagram showing the configuration of the circuit of FIG. 5 in detail.

FIG. 5 is a block diagram of a wide band horizontal size regulation circuit of a display according to the present invention. This horizontal size regulation circuit includes a current controller 100 disposed between a horizontal output circuit 43 and microcomputer 20, in contrast to the horizontal deflection circuit shown in FIG. 3. FIG. 6 shows the configuration of the circuit of FIG. 5 in detail. Referring to FIG. 6, the wide band horizontal size regulation circuit includes the microcomputer 20 for generating a signal for controlling the horizontal size, a PWM-IC 44*a* for outputting a controlled duty pulse for adjusting the amount of current which flows through a deflection yoke H-DY of horizontal output circuit 43 according to the control signal of the microcomputer 20, a deflection controller 44*b* for controlling the amount of current supplied from PWM-IC 44*a* to the choke coil of horizontal output circuit 43, current sensor 44*c* for feeding back the current which flows through the choke coil to the PWM-IC 44*a* to maintain a specific horizontal size, and current controller 100, connected between the horizontal output circuit 43 and microcomputer 20, for controlling the feedback value provided to the PWM-IC 44*a* through the current sensor 44*c*.

The configurations of the deflection controller 44*b* and current sensor 44*c* are identical to those discussed above so that explanations for them have been omitted. The current controller 100 has a plurality of resistors R6, R7 and R8 connected in parallel to a resistor R5 connected to the emitter of the horizontal output transistor Q1 of horizontal output circuit 43. Resistors R6, R7 and R8 are connected to switches SW1, SW2 and SW3 which are respectively turned on/off according to the control signals from the microcomputer 20. The on/off control signal sent from microcomputer 20 to each of switches SW1, SW2 and SW3 is supplied in the same manner as the control signal supplied to the linearity circuit 45 and S-correction circuit 46.

The microcomputer 20 detects the horizontal frequencies and vertical frequencies transmitted from a computer, and carries out bandpass filtering to these frequencies to sense the variation in the frequencies. According to this result, the microcomputer 20 selectively outputs a switching signal to each of switch SW1, SW2 and SW3. The amount of current fed back to the PWM-IC 44*a* is controlled by a voltage divided by resistor R5. Current which flows to the emitter of horizontal output transistor Q1 is transmitted to the third pin of a current sensing port 50 of the PWM-IC 44*a*. The amount of current is changed according to the voltage divided by resistor R5 and resistors R6, R7 and R8 connected in parallel thereto. Accordingly, resistors R6, R7 and R8 are selectively connected, to control the horizontal size according to input frequency bands.

As described above, the present invention varies the control signal of the microcomputer depending on the input frequency, to control the amount of current transmitted from the horizontal output circuit to the PWM-IC. By doing so, the horizontal size can be controlled for the wide band frequency.

It will be apparent to those skilled in the art that various modifications can be made in the Wide Band Horizontal Size Regulation Circuit of a Display of the present invention, without departing from the spirit of the invention. Thus, it is intended that the present invention cover such modifications as well as variations thereof, within the scope of the appended claims and their equivalents.

What is claimed is:

1. A wide band horizontal size regulation circuit of a display device, comprising:

a microcomputer for sensing a variation in input horizontal frequencies and vertical frequencies by bandpass filtering to selectively generate a control signal for regulating a horizontal size of a picture displayed on the display device;

a pulse width modulation integrated circuit for generating a pulse width modulation signal for controlling an amount of current which flows through a horizontal deflection coil of the display device according to the control signal of the microcomputer;

a current sensor for feeding back a current corresponding to a picture state to the pulse width modulation integrated circuit in order to maintain a specific horizontal size of a picture displayed on the display device; and a current controller including a plurality of switches which are selectively switched according to the control signal of the microcomputer, the current controller also including a plurality of resistors selectively connected in parallel, with each of said plurality of resistors being respectively connected to one of said plurality of switches to change an amount of the current fed back through the current sensor to the pulse width modulation integrated circuit, the control signal of the microcomputer varying according to the input horizontal frequencies and vertical frequencies to selectively control selective switching of the plurality of switches to selectively control the amount of the current fed back through the current sensor to the pulse width modulation integrated circuit to control the horizontal size of a picture displayed on the display device according to input frequency bands.

2. The wide band horizontal size regulation circuit as claimed in claim 1, further comprised of the current controller being connected to an emitter of a horizontal output transistor to control feed back of the amount of the current through the current sensor to the pulse width modulation integrated circuit.

3. The wide band horizontal size regulation circuit as claimed in claim 1, further comprised of the current fed back, whose amplitude is controlled by the current controller, being transmitted to a current sensing port of the pulse width modulation integrated circuit.

4. The wide band horizontal size regulation circuit as claimed in claim 2, further comprised of the current fed back, whose amplitude is controlled by the current controller, being transmitted to a current sensing port of the pulse width modulation integrated circuit.

5. A method for wide band horizontal size regulation in a display device, comprising the steps of:

sensing a variation in input horizontal frequencies and vertical frequencies by bandpass filtering by a microcomputer;

generating by the microcomputer a control signal for regulating a horizontal size of a picture displayed on the display device based upon the variation in input horizontal frequencies and vertical frequencies sensed;

generating a pulse width modulation signal by a pulse width modulation integrated circuit to control an amount of current which flows through a horizontal deflection coil of the display device according to the control signal generated by the microcomputer;

feeding back by a current sensor a current corresponding to a picture state to the pulse width modulation integrated circuit in order to maintain a specific horizontal size of a picture displayed on the display device; and selectively controlling an amount of the current fed back through the current sensor to the pulse width modulation integrated circuit by a plurality of switches of a current controller which are selectively switched according to the control signal of the microcomputer to control the horizontal size of a picture displayed on the display device according to input frequency bands, the current controller also including a plurality of resistors selectively connected in parallel, with each of said plurality of resistors being respectively connected to one of said plurality of switches to change the amount of the current fed back through the current sensor to the pulse width modulation integrated circuit, the control signal of the microcomputer varying according to the input horizontal frequencies and vertical frequencies to selectively control selective switching of the plurality of switches to selectively control the amount of the current fed back through the current sensor to the pulse width modulation integrated circuit.

6. The method as claimed in claim 5, further comprised of the current fed back, whose amplitude is controlled by the current controller, being transmitted to a current sensing port of the pulse width modulation integrated circuit.

* * * * *